US012799420B2

(12) United States Patent
Onouchi et al.

(10) Patent No.: US 12,799,420 B2
(45) Date of Patent: Nov. 17, 2026

(54) LUBRICATING OIL COMPOSITION FOR HYBRID VEHICLES

(71) Applicant: CHEVRON JAPAN LTD., Tokyo (JP)

(72) Inventors: Hisanari Onouchi, Ibaraki (JP); Isao Tanaka, Makinohara (JP); Taiki Hattori, Kakegawa (JP)

(73) Assignee: Chevron Japan Limited., Tokyo (JP)

( * ) Notice: Subject to any disclaimer, the term of this patent is extended or adjusted under 35 U.S.C. 154(b) by 0 days.

(21) Appl. No.: 18/700,443

(22) PCT Filed: Oct. 7, 2022

(86) PCT No.: PCT/IB2022/059617

§ 371 (c)(1),
(2) Date: Apr. 11, 2024

(87) PCT Pub. No.: WO2023/067429

PCT Pub. Date: Apr. 27, 2023

(65) Prior Publication Data

US 2024/0409838 A1 Dec. 12, 2024

Related U.S. Application Data

(60) Provisional application No. 63/257,772, filed on Oct. 20, 2021.

(51) Int. Cl.

| | |
|---|---|
| ***C10M 129/34*** | (2006.01) |
| ***C10M 129/72*** | (2006.01) |
| ***C10M 145/30*** | (2006.01) |
| ***C10M 169/04*** | (2006.01) |
| *C10N 20/04* | (2006.01) |
| *C10N 30/12* | (2006.01) |
| *C10N 40/25* | (2006.01) |

(52) U.S. Cl.

CPC ..... *C10M 129/34* (2013.01); *C10M 129/72* (2013.01); *C10M 145/30* (2013.01); *C10M 169/044* (2013.01); *C10M 2207/123* (2013.01); *C10M 2207/282* (2013.01); *C10M 2209/105* (2013.01); *C10N 2020/04* (2013.01); *C10N 2030/12* (2013.01); *C10N 2040/25* (2013.01)

(58) Field of Classification Search

CPC ..... C10M 129/34; C10M 129/72; C10M 145/30; C10M 169/044; C10M 2207/123; C10M 2207/282; C10M 2209/105; C10N 2020/04; C10N 2030/12; C10N 2040/25

See application file for complete search history.

(56) References Cited

U.S. PATENT DOCUMENTS

| | | | | |
|---|---|---|---|---|
| 2,133,734 A | | 10/1938 | Moser | |
| 3,053,768 A | * | 9/1962 | Cupper | C10M 3/00 508/207 |
| 5,227,082 A | * | 7/1993 | Pillon | C10M 133/40 252/392 |
| 5,397,487 A | * | 3/1995 | Pillon | C10M 133/06 508/306 |
| 6,867,171 B2 | * | 3/2005 | Harrison | C07C 57/13 44/418 |
| 7,732,386 B2 | * | 6/2010 | Okazaki | C10M 169/04 508/506 |
| 8,207,099 B2 | | 6/2012 | Loper | |
| 10,479,953 B2 | | 11/2019 | Yeung | |
| 2003/0125218 A1 | | 7/2003 | Cardis | |
| 2009/0163393 A1 | * | 6/2009 | Boffa | C10M 111/02 508/496 |

(Continued)

FOREIGN PATENT DOCUMENTS

CN 107353980 A 11/2017

OTHER PUBLICATIONS

PCT International Search Report mailed on Jan. 17, 2023 issued in Application No. PCT/IB2022/059617, filed on Oct. 7, 2022, 9 pages.

*Primary Examiner* — Ellen M Mcavoy
(74) *Attorney, Agent, or Firm* — Michael Sungjoon Pio

(57) ABSTRACT

The lubricating oil composition includes an oil of lubricating viscosity, one or more compounds containing a carboxylic acid functional group or ester functional group the compound represented by

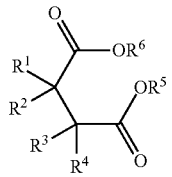

each $R^1$, $R^2$, $R^3$, $R^4$, $R^5$, and $R^6$ is independently hydrogen or hydrocarbyl group; at least one of $R^1$, $R^2$, $R^3$, and $R^4$ is a hydrocarbyl group; and a poly alkylene glycol represented by

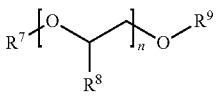

each $R^7$, $R^8$, and $R^9$ is independently hydrogen or hydrocarbyl group and n is from 5 to 1000.

14 Claims, No Drawings

(56) References Cited

U.S. PATENT DOCUMENTS

| | | | | |
|---|---|---|---|---|
| 2013/0005633 | A1* | 1/2013 | Habeeb | C10M 169/041 508/579 |
| 2018/0320103 | A1* | 11/2018 | Hayashi | C10M 159/20 |
| 2019/0249102 | A1* | 8/2019 | Martin | H01M 10/6567 |
| 2022/0041951 | A1* | 2/2022 | Adachi | C10M 153/02 |
| 2022/0169945 | A1* | 6/2022 | Adhvaryu | C10M 141/10 |
| 2023/0167380 | A1* | 6/2023 | Bouvier | C10M 171/00 508/543 |

* cited by examiner

LUBRICATING OIL COMPOSITION FOR HYBRID VEHICLES

TECHNICAL FIELD

This disclosure relates to a lubricating oil compositions and methods of using the same. More specifically, the lubricating oil compositions provide rust protection in hybrid vehicles.

BACKGROUND

Modern lubricating oils are formulated to exacting specifications often set by original equipment manufacturers. This often requires blending carefully selected lubricant additives with base oils of lubricating viscosity. The classes or types of lubricant additives found in lubricating oil compositions include, for example, dispersants, detergents, antioxidants, wear inhibitors, rust inhibitors, corrosion inhibitors, foam inhibitors, and/or friction modifiers. The specific application or use (e.g., hybrid vehicles) will typically govern the set of additives that goes into a lubricating oil composition.

Hybrid vehicles rely on two distinctly different types of motive technologies—internal combustion engine and electric motor. The internal combustion engine mainly drives the vehicle at high speeds. The electric motor drives the vehicle at low speeds and can also assist the internal combustion engine when additional power is needed. It is important for hybrid vehicles to distribute power from the engine and the motor in a well-balanced manner as the vehicle speed increases.

Hybrid vehicle typically feature a start-stop system in which the engine stops when the vehicle comes to a stop and the engine fuel system suspends when the vehicle is driven only by motor or braking. Consequently, accumulation of water and fuel in the oil is a problem as the engine is not able to sufficiently evaporate the water and fuel. This results in the formation of unstable emulsions which negatively impacts engine performance and leads to corrosion/rust in engine parts.

The differences between hybrid vehicles and conventional automobile vehicles are significant enough that conventional engine oils are not optimized for use in hybrid vehicles. As a result, lubricating oil compositions designed specifically for hybrid vehicles are needed. More particularly, there is a need for lubricating oil compositions that improve corrosion/rust protection of engine parts in hybrid vehicles.

SUMMARY

In one aspect, there is provided an internal combustion engine lubricating oil composition comprising: an oil of lubricating viscosity; one or more additive compounds comprising carboxylic acid functional group or ester functional group, wherein the one or more additive compounds is represented by

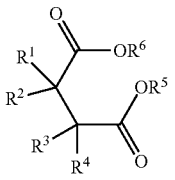

wherein each $R^1$, $R^2$, $R^3$, $R^4$, $R^5$, and $R^6$ is independently hydrogen or hydrocarbyl group; wherein at least one of $R^1$, $R^2$, $R^3$, and $R^4$ is a hydrocarbyl group; and a poly alkylene glycol represented by

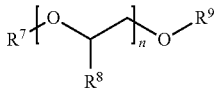

wherein each $R^7$, $R^8$, and $R^9$ is independently hydrogen or hydrocarbyl radical group and wherein n is from 5 to 1000.

In another aspect, there is provided amethod of improving performance of an engine, the method comprising: lubricating the engine with a lubricating oil composition comprising: an oil of lubricating viscosity; one or more additive compounds comprising carboxylic acid functional group or ester functional group, wherein the one or more additive compounds is represented by

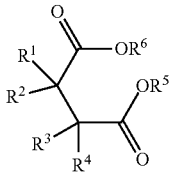

wherein each $R^1$, $R^2$, $R^3$, $R^4$, $R^5$, and $R^6$ is independently hydrogen or hydrocarbyl group; wherein at least one of $R^1$, $R^2$, $R^3$, and $R^4$ is a hydrocarbyl group; and a poly alkylene glycol represented by

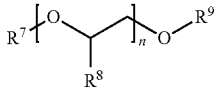

wherein each $R^7$, $R^8$, and $R^9$ is independently hydrogen or hydrocarbyl group and wherein n is from 5 to 1000.

In a further aspect, there is provided a method of improving rust performance of an engine in a hybrid vehicle, wherein the method comprises: lubricating the engine with a lubricating oil composition comprising: an oil of lubricating viscosity; one or more additive compounds comprising carboxylic acid functional group or ester functional group, wherein the one or more additive compounds is represented by

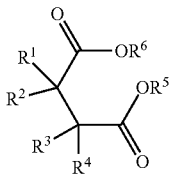

wherein each $R^1$, $R^2$, $R^3$, $R^4$, $R^5$, and $R^6$ is independently hydrogen or hydrocarbyl group; wherein at least one of $R^1$, $R^2$, $R^3$, and $R^4$ is a hydrocarbyl group; and a poly alkylene glycol represented by

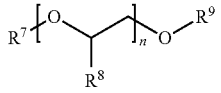

wherein each $R^7$, $R^8$, and $R^9$ is independently hydrogen or hydrocarbyl group and wherein n is from 5 to 1000.

DETAILED DESCRIPTION

While the disclosure is susceptible to various modifications and alternative forms, specific embodiments thereof are herein described in detail. It should be understood, however, that the description herein of specific embodiments is not intended to limit the disclosure to the particular forms disclosed, but on the contrary, the intention is to cover all modifications, equivalents, and alternatives falling within the spirit and scope of the disclosure as defined by the appended claims.

To facilitate the understanding of the subject matter disclosed herein, a number of terms, abbreviations or other shorthand as used herein are defined below. Any term, abbreviation or shorthand not defined is understood to have the ordinary meaning used by a skilled artisan contemporaneous with the submission of this application.

As used herein, the following terms have the following meanings, unless expressly stated to the contrary.

A "major amount" means in excess of 50 weight % of a composition.

A "minor amount" means less than 50 weight % of a composition, expressed in respect of the stated additive and in respect of the total mass of all the additives present in the composition, reckoned as active ingredient of the additive or additives.

"Active ingredients" or "actives" or "oil free" refers to additive material that is not diluent or solvent.

The term "oil soluble" means that for a given additive, the amount needed to provide the desired level of activity or performance can be incorporated by being dissolved, dispersed or suspended in an oil of lubricating viscosity. Usually, this means that at least 0.001% by weight of the additive can be incorporated in a lubricating oil composition. The term "fuel soluble" is an analogous expression for additives dissolved, dispersed or suspended in fuel.

An "engine" or a "combustion engine" is a heat engine where the combustion of fuel occurs in a combustion chamber. An "internal combustion engine" is a heat engine where the combustion of fuel occurs in a confined space ("combustion chamber"). A "spark ignition engine" is a heat engine where the combustion is ignited by a spark, usually from a spark plug. This is contrast to a "compression-ignition engine," typically a diesel engine, where the heat generated from compression together with injection of fuel is sufficient to initiate combustion without an external spark.

The term "hydrocarbyl" refers to a chemical group or moiety derived from hydrocarbons including saturated and unsaturated hydrocarbons. Examples of hydrocarbyl groups include alkenyl, alkyl, polyalkenyl, polyalkyl, phenyl, and the like.

All percentages reported are weight % on an active ingredient basis (i.e., without regard to carrier or diluent oil) unless otherwise stated.

All ASTM standards referred to herein are the most current versions as of the filing date of the present application.

The present invention provides a lubricating oil composition that is useful for engines (e.g., engines in hybrid vehicles) that are particularly susceptible to corrosion and/or wear. In one embodiment, the present invention provides a lubricating oil composition comprising: (a) a major amount of an oil of lubricating viscosity; (b) one or more additive compounds containing a carboxylic acid functional group or ester functional group; and (c) polypropylene glycol. Optionally, the present invention further comprises a polarity modifier.

Lubricating Oil Additives

The lubricating oil composition of the present invention includes lubricating oil additives described herein.

A lubricating oil additive composition of the present invention includes an additive compound comprising carboxylic acid functional group or ester functional group, wherein the compound is represented by formula (I), Formula I

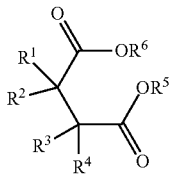

where each $R^1$, $R^2$, $R^3$, $R^4$, $R^5$ and $R^6$ is independently a hydrogen or a hydrocarbyl group, wherein at least one of $R^1$, $R^2$, $R^3$, and $R^4$ is a hydrocarbyl group. In some embodiments, the inventive compound is a di-carboxylic acid, wherein $R^5$ is hydrogen and $R^6$ is hydrogen.

In some embodiments, the hydrocarbyl group can be an alkyl group or an alkenyl group. Alkyl groups refer to saturated hydrocarbyl groups, which can be linear, branched, cyclic, or a combination of cyclic, linear and/or branched. Alkenyl groups refer to unsaturated hydrocarbyl groups, which can be linear, branched, cyclic, or a combination of cyclic, linear and/or branched.

In some embodiments, the hydrocarbyl group of $R^1$, $R^2$, $R^3$, or $R^4$ is independently a moiety having 1 to 400 carbon, for example, 1 to 300 carbon atoms, 1 to 200 carbon atoms, 1 to 100 carbon atoms, 1 to 50 carbon atoms, 1 to 30 carbon atoms, or 1 to 25 carbon atoms. Suitable examples of $R^1$, $R^2$, $R^3$, or $R^4$ include fatty acid moieties (i.e., those derived from fatty acids) and isoaliphatic acid moieties (e.g., those derived from 8-methyloctadecanoic acid). In one embodiment, at least one of $R^1$, $R^2$, $R^3$, and $R^4$ is a dodecenyl group. In one embodiment, at least one of $R^1$, $R^2$, $R^3$, and $R^4$ is an octadecenyl group. In one embodiment, at least one of $R^1$, $R^2$, $R^3$, and $R^4$ is a tetrapropenyl group.

In some embodiments, the hydrocarbyl group of $R^5$ or $R^6$ is independently a moiety having 1 to 50 carbon atoms, for example, 1 to 40 carbon atoms, 1 to 30 carbon atoms, 1 to 25 carbon atoms, or 1 to 20 carbon atoms.

Examples of lubricating oil additives of the present invention include tetrapropenyl succinic acid, pentylsuccinic acid, octylsuccinic acid, ethyl octylsuccinic acid, and the like.

In some embodiments, the lubricating oil composition of the present invention includes both additives described by formula (I).

In general, the one or more compounds containing the carboxylic acid, or ester functional group can be present in the lubricating oil composition of the present disclosure in an amount ranging from about 0.15 to about 5.0 wt. %, based on the total weight of the lubricating oil composition.

In one embodiment, the one or more additive compounds can be present in the lubricating oil composition of the present disclosure in an amount ranging from about 0.15 to about 4.0 wt. %, based on the total weight of the lubricating oil composition. In one embodiment, the one or more additive compounds can be present in the lubricating oil composition of the present disclosure in an amount ranging from about 0.15 to about 3.0 wt. %, based on the total weight of the lubricating oil composition. In another embodiment, the one or more additive compounds can be present in the lubricating oil composition of the present disclosure in an amount ranging from about 0.15 to about 2.0 wt. %, based on the total weight of the lubricating oil composition.

Poly Alkylene Glycol

The lubricating oil composition of the present invention includes a poly alkylene glycol. According to an embodiment, poly alkylene glycol can act as an emulsifier and is represented by formula (II)

Formula II

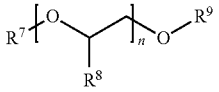

wherein $R^7$, $R^8$, and $R^9$ are each independently a hydrogen radical or hydrocarbyl radical and n is from 5 to 1000, such as from 5 to 500, 7 to 500, 5 to 100, 5 to 75, 7 to 100, 7 to 75, and so forth. In some embodiments, n is from 7 to 900, 20 to 800, 50 to 750, 75 to 500, 100 to 400 or 200 to 300.

In some embodiments, the polypropylene glycol has a molecular weight (MW) of about 400 g/mol to about 4000 g/mol such as from about 500 g/mol to 3500 g/mol, 750 g/mol to 3000 g/mol, 1000 g/mol to 2500 g/mol, 1250 g/mol to 2250 g/mol, 1500 g/mol to 2500 g/mol and so forth.

The polypropylene may be present in an amount ranging from about 0.15 to about 5.0 wt. %, based on the total weight of the lubricating oil composition.

In one embodiment, the polypropylene glycol can be present in the lubricating oil composition of the present disclosure in an amount ranging from about 0.15 to about 4.0 wt. %, based on the total weight of the lubricating oil composition. In one embodiment, the polypropylene glycol can be present in the lubricating oil composition of the present disclosure in an amount ranging from about 0.15 to about 3.0 wt. %, based on the total weight of the lubricating oil composition. In another embodiment, the polypropylene glycol can be present in the lubricating oil composition of the present disclosure in an amount ranging from about 0.15 to about 2.0 wt. %, based on the total weight of the lubricating oil composition.

Diester Compound

In some embodiments, the present invention may comprise a diester compound. This optional diester can act as a polarity modifier.

In one embodiment, the diesters which can be obtained from these aliphatic dibasic acids and alcohols include, for example, di(1-ethylpropyl) adipate, di(3-methylbutyl) adipate, di(1,3-methylbutyl) adipate, di(2-ethylhexyl) adipate, di(isononyl) adipate, di(isodecyl) adipate, di(undecyl) adipate, di(tridecyl) adipate, di(isotetradecyl) adipate, di(2,2,4-trimethylpentyl) adipate, di[mixed (2-ethylhexyl, isononyl)] adipate, di(1-ethylpropyl) azelate, di(3-methylbutyl) azelate, di(2-ethylbutyl) azelate, di(2-ethylhexyl) azelate, di(isooctyl) azelate, di(isononyl) azelate, di(isodecyl) azelate, di(tridecyl) azelate, di[mixed (2-ethylhexyl, isononyl)] azelate, di[mixed (2-ethylhexyl, decyl) azelate, di[mixed (2-ethylhexyl, isodecyl)] azelate, di[mixed (2-ethylhexyl, 2-propylheptyl)] azelate, di(n-butyl) sebacate, di(isobutyl) sebacate, di(1-ethylpropyl) sebacate, di(1,3-methylbutyl) sebacate, di(2-methylbutyl) sebacate, di(2-ethylhexyl) sebacate, di[2-(2-ethylbutoxy)ethyl] sebacate, di(2,2,4-trimethylbenzyl) sebacate, di(isononyl) sebacate, di(isodecyl) sebacate, di(isoundecyl) sebacate, di(tridecyl) sebacate, di(isotetradecyl) sebacate, di[mixed (2-ethylhexyl, isononyl)] sebacate, di(2-ethylhexyl) glutarate, di(isoundecyl) glutarate, and di(isotetradecyl) glutarate.

The diester may be present in an amount greater than 0.1 wt. %, based on the total weight of the lubricating oil composition.

In one embodiment, the diester can be present in the lubricating oil composition of the present disclosure in an amount ranging from about 0.15 to about 4.0 wt. %, based on the total weight of the lubricating oil composition.

Lubricating Oil Compositions

The oil of lubricating viscosity (sometimes referred to as "base stock" or "base oil") is the primary liquid constituent of a lubricant, into which additives and possibly other oils are blended, for example to produce a final lubricant (or lubricant composition). A base oil, which is useful for making concentrates as well as for making lubricating oil compositions therefrom, may be selected from natural (vegetable, animal or mineral) and synthetic lubricating oils and mixtures thereof.

Definitions for the base stocks and base oils in this disclosure are the same as those found in American Petroleum Institute (API) Publication 1509 Annex E ("API Base Oil Interchangeability Guidelines for Passenger Car Motor Oils and Diesel Engine Oils," December 2016). Group I base stocks contain less than 90% saturates and/or greater than 0.03% sulfur and have a viscosity index greater than or equal to 80 and less than 120 using the test methods specified in Table E-1. Group II base stocks contain greater than or equal to 90% saturates and less than or equal to 0.03% sulfur and have a viscosity index greater than or equal to 80 and less than 120 using the test methods specified in Table E-1. Group III base stocks contain greater than or equal to 90% saturates and less than or equal to 0.03% sulfur and have a viscosity index greater than or equal to 120 using the test methods specified in Table E-1. Group IV base stocks are polyalphaolefins (PAO). Group V base stocks include all other base stocks not included in Group I, II, III, or IV.

Natural oils include animal oils, vegetable oils (e.g., castor oil and lard oil), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Synthetic oils include hydrocarbon oil. Hydrocarbon oils include oils such as polymerized and interpolymerized olefins (e.g., polybutylenes, polypropylenes, propylene isobutylene copolymers, ethylene-olefin copolymers, and ethylene-alphaolefin copolymers). Polyalphaolefin (PAO) oil base stocks are commonly used synthetic hydrocarbon oil. By way of example, PAOs derived from $C_8$ to $C_{14}$ olefins, e.g., $C_8$, $C_{10}$, $C_{12}$, $C_{14}$ olefins or mixtures thereof, may be utilized.

Other useful fluids for use as base oils include non-conventional or unconventional base stocks that have been processed, preferably catalytically, or synthesized to provide high performance characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

Base oils for use in the lubricating oil compositions of present disclosure are any of the variety of oils corresponding to API Group I, Group II, Group III, Group IV, and Group V oils, and mixtures thereof, preferably API Group II, Group III, Group IV, and Group V oils, and mixtures thereof, more preferably the Group III to Group V base oils due to their exceptional volatility, stability, viscometric and cleanliness features.

Typically, the base oil will have a kinematic viscosity at 100° C. (ASTM D445) in a range of 2.5 to 20 $mm^2/s$ (e.g., 3 to 12 $mm^2/s$, 4 to 10 $mm^2/s$, or 4.5 to 8 $mm^2/s$).

The present lubricating oil compositions may also contain conventional lubricant additives for imparting auxiliary functions to give a finished lubricating oil composition in which these additives are dispersed or dissolved. For example, the lubricating oil compositions can be blended with antioxidants, ashless dispersants, anti-wear agents, detergents such as metal detergents, rust inhibitors, dehazing agents, demulsifying agents, friction modifiers, metal deactivating agents, pour point depressants, viscosity modifiers, antifoaming agents, co-solvents, package compatibilizers, corrosion-inhibitors, dyes, extreme pressure agents and the like and mixtures thereof. A variety of the additives are known and commercially available. These additives, or their analogous compounds, can be employed for the preparation of the lubricating oil compositions of the invention by the usual blending procedures.

Each of the foregoing additives, when used, is used at a functionally effective amount to impart the desired properties to the lubricant. Thus, for example, if an additive is an ashless dispersant, a functionally effective amount of this ashless dispersant would be an amount sufficient to impart the desired dispersancy characteristics to the lubricant. Generally, the concentration of each of these additives, when used, may range, unless otherwise specified, from about 0.001 to about 20 wt %, such as about 0.01 to about 10 wt %.

Additional Lubricating Oil Additives

The lubricating oil compositions of the present disclosure may also contain other conventional additives that can impart a desirable property to or improve the lubricating oil composition in which these additives are dispersed or dissolved. Any additive known to a person of ordinary skill in the art may be used in the lubricating oil compositions disclosed herein. Some suitable additives have been described in Mortier et al., "Chemistry and Technology of Lubricants", 2nd Edition, London, Springer, (1996); and Leslie R. Rudnick, "Lubricant Additives: Chemistry and Applications", New York, Marcel Dekker (2003), both of which are incorporated herein by reference. For example, the lubricating oil compositions can be blended with antioxidants (e.g., alkylated diphenylamine, phenolic antioxidants), anti-wear agents, detergents such as metal detergents, rust inhibitors, dehazing agents, demulsifying agents, metal deactivating agents, friction modifiers (e.g., ester-based friction modifier), viscosity modifiers (e.g., olefin copolymer), pour point depressants, antifoaming agents (e.g., silicon-based foam inhibitors), co-solvents, corrosion-inhibitors, dispersants, multifunctional agents, dyes, extreme pressure agents and the like and mixtures thereof. A variety of the additives are known and commercially available. These additives, or their analogous compounds, can be employed for the preparation of the lubricating oil compositions of the disclosure by the usual blending procedures.

In the preparation of lubricating oil formulations, it is common practice to introduce the additives in the form of 10 to 100 wt. % active ingredient concentrates in hydrocarbon oil, e.g. mineral lubricating oil, or other suitable solvent.

Usually these concentrates may be diluted with 3 to 100, e.g., 5 to 40, parts by weight of lubricating oil per part by weight of the additive package in forming finished lubricants, e.g. crankcase motor oils. The purpose of concentrates, of course, is to make the handling of the various materials less difficult and awkward as well as to facilitate solution or dispersion in the final blend.

Each of the foregoing additives, when used, is used at a functionally effective amount to impart the desired properties to the lubricant. Thus, for example, if an additive is a friction modifier, a functionally effective amount of this friction modifier would be an amount sufficient to impart the desired friction modifying characteristics to the lubricant.

In general, the concentration of each of the additives in the lubricating oil composition, when used, may range from about 0.001 wt. % to about 20 wt. %, from about 0.01 wt. % to about 15 wt. %, or from about 0.1 wt. % to about 10 wt. %, from about 0.005 wt. % to about 5 wt. %, or from about 0.1 wt. % to about 2.5 wt. %, based on the total weight of the lubricating oil composition. Further, the total amount of the additives in the lubricating oil composition may range from about 0.001 wt. % to about 20 wt. %, from about 0.01 wt. % to about 10 wt. %, or from about 0.1 wt. % to about 5 wt. %, based on the total weight of the lubricating oil composition.

The following examples are presented to exemplify embodiments of the disclosure but are not intended to limit the disclosure to the specific embodiments set forth. Unless indicated to the contrary, all parts and percentages are by weight. All numerical values are approximate. When numerical ranges are given, it should be understood that embodiments outside the stated ranges may still fall within the scope of the disclosure. Specific details described in each example should not be construed as necessary features of the disclosure.

It will be understood that various modifications may be made to the embodiments disclosed herein. Therefore, the above description should not be construed as limiting, but merely as exemplifications of preferred embodiments. For example, the functions described above and implemented as the best mode for operating the present disclosure are for illustration purposes only. Other arrangements and methods may be implemented by those skilled in the art without departing from the scope and spirit of this disclosure. Moreover, those skilled in the art will envision other modifications within the scope and spirit of the claims appended hereto.

EXAMPLES

The following examples are intended for illustrative purposes only and do not limit in any way the scope of the present disclosure.

The lubricating oils were evaluated by the Japanese Industrial Standard (JIS) K2246 test that has been slightly modified for hybrid vehicle lubricants.

JIS K2246 test involves coating test piece sample with test oil and checking for rusting on the test sample. In the modified JIS K2246 test, the test piece sample is coated with a mixture containing test oil and distilled water. Table 2 summarizes the JIS K2246 test results.

The test piece sample is placed in a humidity cabinet above 95% relative humidity (RH) at 49° C. and allowed to stand for 72 hours. The test assesses the ability of oils to prevent rust on metal materials or metal products, mainly consisting of iron and steel. The ASTM D1748 test (Humidity cabinet rust test) is run in a similar fashion. A lower rust rating indicates better anti-corrosion performance. A rating of 10 or lower indicates a pass rating.

The mixture containing test oil and distilled water was prepared according to the following steps:

1. Mix 30 ml of distilled water with 270 ml of test oil in a plastic container.
2. Transfer the mixture of test oil and distilled water to a 500 ml container.
3. Stir the mixture containing the test oil and distilled water on the day of the JIS K2246 test followed by 30 seconds handshaking.
4. Heat the test oil in a convection oven at 70° C. for 30 min.
5. After 30 minutes, remove the test oil from oven and allow the test oil to cool down to room temperature.
6. Just prior to soaking the test sample in the test oil, handshake the test oil again for 30 seconds.
7. Start the JIS K2246 test.

Baseline Formulation

A lubricating oil composition was prepared that contained a major amount of a group III base oil of lubricating viscosity and the following additives, to provide a finished oil having a 0W-20 SAE viscosity grade:

1. A mixture of borated and non-borated succinimide dispersant;
2. 1240 ppm in terms of calcium content of overbased calcium detergents;
3. 450 ppm in terms of magnesium content of an overbased magnesium detergent;
4. 660 ppm in terms of phosphorus content, of approximately at 2:1 mixture of primary to secondary zinc dialkyldithiophosphate;
5. 270 ppm in terms of molybdenum of a molybdenum succinimide complex;
6. alkylated diphenylamine antioxidant;
7. an ester-based friction modifier
8. a minor amount of silicon-based foam inhibitor, olefin copolymer (OCP) viscosity modifier, and pour point depressant.

Table 1 below summarizes the compounds that were tested.

TABLE 1

| | |
|---|---|
| Compound A | tetrapropenyl succinic acid |
| Compound B | monoester of propane-1,2-diol and tetrapropenyl succinic acid |
| Compound C | succinate ester reaction product of 1000 MW polyisobutenyl succinic anhydride and pentaerythritol |
| Compound D | glycerol monooleate |
| Compound E | ethoxylated dodecylphenol |
| Compound F | polypropylene glycol an approximate MW of 2000 g/mol |
| Compound G | diisodecyl adipate |

Inventive examples 1-4 and comparative examples 1-11 were formulated by adding compounds A-G in the amounts specified in Table 2.

TABLE 2

| Compound (wt %) | Ex. 1 | Ex. 2 | Ex. 3 | Ex. 4 | Comp. Ex. 1 | Comp. Ex. 2 | Comp. Ex. 3 | Comp. Ex. 4 |
|---|---|---|---|---|---|---|---|---|
| A | 0.2 | 0.3 | 0.2 | 0.3 | | 0.1 | 0.2 | |
| B | | | | | | | | |
| C | | | | | | | | |
| D | | | | | | | | |
| E | | | | | | | | |
| F | 0.2 | 0.3 | 0.2 | 0.3 | | 0.1 | | 0.2 |
| G | | | 0.2 | 0.3 | | | | |
| JIS K2246 Rating (Avg. 3 runs) | 8.0 | 5.7 | 5.3 | 1.0 | 31 | 27 | 15 | 26 |

| Compound | Comp. Ex. 5 | Comp. Ex. 6 | Comp. Ex. 7 | Comp. Ex. 8 | Comp. Ex. 9 | Comp. Ex. 10 | Comp. Ex. 11 |
|---|---|---|---|---|---|---|---|
| A | 0.2 | | | | | | |
| B | | 0.2 | | | 0.2 | | |
| C | | | 0.2 | | | 0.2 | |
| D | | | | 0.2 | | | 0.2 |
| E | 0.2 | 0.2 | 0.2 | 0.2 | | | |
| F | | | | | 0.2 | 0.2 | 0.2 |
| G | | | | | | | |
| JIS K2246 Rating (Avg. 3 runs) | 16 | 16 | 26 | 20 | 13 | 24 | 13 |

Examples 1 and 2 show that a combination of a carboxylate (compound A) and polypropylene glycol (compound F) shows good synergistic performance to reduce corrosion. When a diester-based polarity modifier (compound G) is added, the rust performance is further enhanced.

Comparative examples 1 and 2 which contain no carboxylate and poly alkylene glycol combination or low dosage of additives, respectively, show poor rust performance. Comparative examples 3 and 4 demonstrate that neither compound A nor compound F function effectively on their own.

Comparative examples 5-8 show that the ethoxylated phenol additive (compound E) is not as effective as compound F in combination with compound A as a rust inhibiting composition. Similarly, comparative examples 9-10 show that various other carboxylates (compounds B-D) are not as effective as compound A in combination with compound F as a rust inhibiting composition.

All documents described herein are incorporated by reference herein, including any priority documents and/or testing procedures to the extent they are not inconsistent with this text. As is apparent from the foregoing general description and the specific embodiments, while forms of the present disclosure have been illustrated and described, various modifications can be made without departing from the spirit and scope of the present disclosure. Accordingly, it is not intended that the present disclosure be limited thereby.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, within a range includes every point or individual value between its end points even though not explicitly recited. Thus, every point or individual value may serve as its own lower or upper limit combined with any other point or individual value or any other lower or upper limit, to recite a range not explicitly recited.

Likewise, the term "comprising" is considered synonymous with the term "including." Likewise whenever a composition, an element or a group of elements is preceded with the transitional phrase "comprising," it is understood that we also contemplate the same composition or group of elements with transitional phrases "consisting essentially of," "consisting of," "selected from the group of consisting of," or "is" preceding the recitation of the composition, element, or elements and vice versa.

The terms "a" and "the" as used herein are understood to encompass the plural as well as the singular.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

The foregoing description of the disclosure illustrates and describes the present disclosure. Additionally, the disclosure shows and describes only the preferred embodiments but, as mentioned above, it is to be understood that the disclosure is capable of use in various other combinations, modifications, and environments and is capable of changes or modifications within the scope of the concept as expressed herein, commensurate with the above teachings and/or the skill or knowledge of the relevant art. While the foregoing is directed to embodiments of the present disclosure, other and further embodiments of the disclosure may be devised without departing from the basic scope thereof, and the scope thereof is determined by the claims that follow.

It is understood that when combinations, subsets, groups, etc. of elements are disclosed (e.g., combinations of components in a composition, or combinations of steps in a method), that while specific reference of each of the various individual and collective combinations and permutations of these elements may not be explicitly disclosed, each is specifically contemplated and described herein.

The embodiments described hereinabove are further intended to explain best modes known of practicing it and to enable others skilled in the art to utilize the disclosure in such, or other, embodiments and with the various modifications required by the particular applications or uses. Accordingly, the description is not intended to limit it to the form disclosed herein. Also, it is intended that the appended claims be construed to include alternative embodiments.

The invention claimed is:

1. A method of improving performance of an engine in a hybrid vehicle, the method comprising:

lubricating the engine with a lubricating oil composition comprising:

an oil of lubricating viscosity;

one or more additive compounds comprising carboxylic acid functional group or ester functional group, wherein the one or more additive compounds is represented by

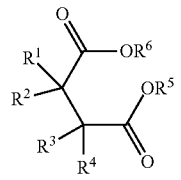

wherein each $R^1$, $R^2$, $R^3$, $R^4$, $R^5$, and $R^6$ is independently hydrogen or hydrocarbyl group; wherein at least one of $R^1$, $R^2$, $R^3$, and $R^4$ is a hydrocarbyl group; and a poly alkylene glycol represented by

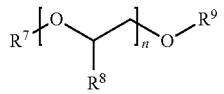

wherein each $R^7$, $R^8$, and $R^9$ is independently hydrogen or hydrocarbyl group and wherein n is from 5 to 1000.

2. The method of claim 1, wherein the one or more additive compounds is a dicarboxylic acid.

3. The method of claim 1, wherein the one or more additive compounds is a mono-alkyl succinic acid, mono-alkenyl succinic acid, mono-alkynyl succinic acid.

4. The method of claim 1, wherein one of $R^1$, $R^2$, $R^3$, and $R^4$ is a hydrocarbyl group having about 3 to about 20 carbons.

5. The method of claim 1, wherein the poly alkylene glycol has a molecular weight from 400 g/mol to 10000 g/mol.

6. The method of claim 1, wherein the lubricating oil composition further comprises a polarity modifier, dispersant, detergent, anti-wear agent, antioxidant, friction modifier, viscosity modifier, or pour point depressant.

7. The method of claim 6, wherein the polarity modifier is a diester.

8. The method of claim 7, wherein the diester is a di(1-ethylpropyl) adipate, di(3-methylbutyl) adipate, di(1,3-methylbutyl) adipate, di(2-ethylhexyl) adipate, di(isononyl) adipate, di(isodecyl) adipate, di(undecyl) adipate, di(tridecyl) adipate, di(isotetradecyl) adipate, di(2,2,4-trimethylpentyl) adipate, di[mixed (2-ethylhexyl, isononyl)] adipate, di(1-ethylpropyl) azelate, di(3-methylbutyl) azelate, di(2-ethylbutyl) azelate, di(2-ethylhexyl) azelate, di(isooctyl) azelate, di(isononyl) azelate, di(isodecyl) azelate, di(tridecyl) azelate, di[mixed (2-ethylhexyl, isononyl)] azelate, di[mixed (2-ethylhexyl, decyl) azelate, di[mixed (2-ethylhexyl, isodecyl)] azelate, di[mixed (2-ethylhexyl, 2-propylheptyl)] azelate, di(n-butyl) sebacate, di(isobutyl) sebacate, di(1-ethylpropyl) sebacate, di(1,3-methylbutyl) sebacate, di(2-methylbutyl) sebacate, di(2-ethylhexyl) sebacate, di[2-(2-ethylbutoxy)ethyl] sebacate, di(2,2,4-trimethylbenzyl) sebacate, di(isononyl) sebacate, di(isodecyl) sebacate, di(isoundecyl) sebacate, di(tridecyl) sebacate, di(isotetradecyl) sebacate, di[mixed (2-ethylhexyl, isononyl)] sebacate, di(2-ethylhexyl) glutarate, di(isoundecyl) glutarate, or di(isotetradecyl) glutarate.

9. A method of improving rust performance of an engine in a hybrid vehicle, wherein the method comprises:

lubricating the engine with a lubricating oil composition comprising:

an oil of lubricating viscosity;

one or more additive compounds comprising carboxylic acid functional group or ester functional group, wherein the one or more additive compounds is represented by

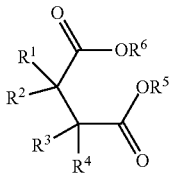

wherein each $R^1$, $R^2$, $R^3$, $R^4$, $R^5$, and $R^6$ is independently hydrogen or hydrocarbyl group; wherein at least one of $R^1$, $R^2$, $R^3$, and $R^4$ is a hydrocarbyl group; and a poly alkylene glycol represented by

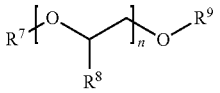

wherein each $R^7$, $R^8$, and $R^9$ is independently hydrogen or hydrocarbyl group and wherein n is from 5 to 1000.

10. The method of claim 9, wherein the one or more additive compounds is a dicarboxylic acid.

11. The method of claim 9, wherein the one or more additive compounds is a mono-alkyl succinic acid, mono-alkenyl succinic acid, mono-alkynyl succinic acid.

12. The method of claim 9, wherein one of $R^1$, $R^2$, $R^3$, and $R^4$ is a hydrocarbyl group having about 3 to about 20 carbons.

13. The method of claim 9, wherein the poly alkylene glycol has a molecular weight from 400 g/mol to 10000 g/mol.

14. The method of claim 9, wherein the lubricating oil composition further comprises a polarity modifier, dispersant, detergent, anti-wear agent, antioxidant, friction modifier, viscosity modifier, or pour point depressant.

* * * * *